US011117274B2

(12) United States Patent
Mojica

(10) Patent No.: US 11,117,274 B2
(45) Date of Patent: Sep. 14, 2021

(54) KNIFE WITH FIRE STARTING IMPLEMENT

(71) Applicant: Outdoor Element, LLC, Englewood, CO (US)

(72) Inventor: Michael John Mojica, Englewood, CO (US)

(73) Assignee: Outdoor Element, LLC, Englewood, CO (US)

( * ) Notice: Subject to any disclaimer, the term of this patent is extended or adjusted under 35 U.S.C. 154(b) by 795 days.

(21) Appl. No.: 15/340,894

(22) Filed: Nov. 1, 2016

(65) Prior Publication Data

US 2018/0117779 A1 May 3, 2018

(51) Int. Cl.

| | |
|---|---|
| ***B26B 11/00*** | (2006.01) |
| ***B26B 3/00*** | (2006.01) |
| ***F23Q 1/06*** | (2006.01) |
| ***B26B 9/02*** | (2006.01) |
| ***B26B 9/00*** | (2006.01) |

(52) U.S. Cl.

CPC ..... *B26B 11/00* (2013.01); *B26B 3/00* (2013.01); *B26B 9/00* (2013.01); *B26B 9/02* (2013.01); *B26B 11/006* (2013.01); *F23Q 1/06* (2013.01)

(58) Field of Classification Search

CPC ... B26B 11/00; F23Q 1/06; F23Q 2/32; F23Q 2/48

See application file for complete search history.

(56) References Cited

U.S. PATENT DOCUMENTS 1,386,956 A * 8/1921 Sanders ..... B26B 3/00 30/342
2,037,943 A * 4/1936 Stiehl ..... B26B 1/10 30/340
2,205,769 A * 6/1940 Sweetland ..... A01K 87/08 81/492
2,545,121 A * 3/1951 Szopatedv ..... B26B 3/06 30/142
2,651,106 A * 9/1953 Breitzke ..... B26B 3/06 30/125
2,681,505 A * 6/1954 Flanagan ..... B26B 3/06 30/125
2,691,287 A * 10/1954 Mosch ..... F23Q 2/32 431/139
2,828,855 A * 4/1958 Mosch ..... B25F 1/04 206/234
2,879,591 A * 3/1959 Bennett ..... B26B 11/00 30/125
2,993,586 A * 7/1961 Mosch ..... B26B 11/008 206/216
3,266,081 A * 8/1966 Heim ..... B25G 1/00 16/110.1
3,760,438 A * 9/1973 White ..... B25F 1/02 7/106
3,875,600 A * 4/1975 Reveaux ..... B25F 1/00 7/106
4,669,186 A * 6/1987 Liu ..... B26B 11/008 30/125

(Continued)

*Primary Examiner* — Jorge A Pereiro
(74) *Attorney, Agent, or Firm* — Holland & Hart LLP

(57) ABSTRACT

The invention relates to a novel knife with fire igniting capabilities as part of the knife itself. More specifically, the present invention provides for both a knife, and fire starting capability in one piece, which are both crucial to outdoor survival and useful in general camping and hiking activities. The handle can be hollow to contain a small survival kit, and the grips can be wrapped in paracord for other multiple outdoor survival uses.

14 Claims, 6 Drawing Sheets

(56) References Cited

U.S. PATENT DOCUMENTS 4,770,669 A * 9/1988 Allen ..... C10L 11/00 44/510
4,882,841 A * 11/1989 Margolis ..... B26B 11/001 30/125
6,119,681 A * 9/2000 Lilke ..... B05C 17/0053 126/401
6,223,372 B1 * 5/2001 Barber ..... B25F 1/00 7/118
D484,770 S * 1/2004 Green ..... B25F 1/04 D8/99
D513,579 S * 1/2006 Barber ..... D8/105
7,000,323 B1 * 2/2006 Hatcher ..... B26B 1/046 30/155
9,249,602 B1 * 2/2016 Greer ..... E05B 19/04
2004/0174700 A1 * 9/2004 Zirk ..... B26B 1/04 362/119
2005/0144730 A1 * 7/2005 Barber ..... B25B 7/22 7/138
2005/0144790 A1 * 7/2005 Stanley, Jr. ..... B25G 1/12 30/350
2006/0272157 A1 * 12/2006 Zeng ..... B26B 1/048 30/161
2010/0088899 A1 * 4/2010 Garcia ..... B26B 1/04 30/123
2011/0010949 A1 * 1/2011 Garrison ..... B26B 3/04 30/279.2
2013/0312270 A1 * 11/2013 Gutierrez ..... B26B 1/044 30/161
2015/0197022 A1 * 7/2015 Pelton ..... B26B 29/025 30/153
2015/0239136 A1 * 8/2015 Taylor ..... B25G 1/102 30/165
2018/0031234 A1 * 2/2018 Falkenhayn ..... F23Q 1/06
2018/0100649 A1 * 4/2018 Mojica ..... F23Q 1/06
2018/0250838 A2 * 9/2018 Henry ..... B22C 9/22

* cited by examiner

KNIFE WITH FIRE STARTING IMPLEMENT

CROSS REFERENCES TO RELATED APPLICATIONS

This Application claims benefit to Provisional Application 62/240,478 filed on Oct. 12, 2015 for the invention disclosed herein.

FIELD

The invention relates to a novel knife with fire igniting capabilities as part of the knife itself. More specifically, the present invention provides for both a knife, and fire starting capability in one piece, which are both crucial to outdoor survival and useful in general camping and hiking activities.

BACKGROUND OF THE INVENTION

The invention most closely corresponds with USPTO Class D07/642 wherein Class D07 relates to knife design, and sub-class 642 includes a knife or blade. Additionally, Class and subclass 431/273 wherein Class 431 includes flints and subclass 273 includes lighters.

The invention discloses a single-bladed knife with fire starting capabilities housed within the knife itself. The knife may be a fixed blade or folding design with a fabric, leather or vinyl grip.

It is widely held that if you are lost in the woods or battling the elements, the key piece of equipment to have is a good survival knife. Survival knives not only act as durable tools to cut down branches or skin animals, but they can also be the difference between life and death. The inventive knife also provides fire starting capability which combines with the other useful features of a survival knife to add significant utility.

SUMMARY, OBJECTS AND ADVANTAGES

The preferred embodiment of the present invention is essentially comprised of a sparking and/or combustible material assembled with a spring and friction or spark wheel housed within the handle of the knife. This could be a hunting type knife or any knife utilized in outdoor activities such as camping or hiking where the need to ignite fires relates to an appropriate amount of gear a user carries. In the instance of backpacking, the lighter the load, the more ideal or even crucial to the user. The present inventive knife has contouring useful for cutting, sawing or prying.

The sparking material may be made of ferrocerium or flint or other sparking elements. The friction portion in the form of a wheel is in close proximity to the sparking element embodied in the knife handle housing. The wheel may be made of high carbon steel or other material that will generate sparks or combustion when rubbed with the combustible or sparking portion. The spark wheel is rotated by a user and can accomplished with one hand. The spark wheel is aligned so that it is contact with the flint/ferrocerium. When the spark wheel is rotated, sparks are generated by the flint and projected to an ignition or fire creation area at the end of the knife handle. The fire-starting elements are located opposite the knife blade for added safety.

Another embodiment of the present invention is that the knife may also have a hollow handle which can house a small survival kit. A user can designate what to place in a kit, but typical items would be a compass, bandages, matches or the like. In the present invention, there is no need for fire starting mechanisms because the knife provides that feature within its frame.

A further embodiment is wherein the knife handle is comprised of fabric in the form of a wrapped paracord. Paracord is typically a nylon rope that offers significant strength yet is not heavy or cumbersome. In the outdoors paracord can be used to create a fishing line or to secure gear, among other numerous uses.

Whether climbing or camping, there is always a need for a way to make a fire. This could mean survival or not in an overnight situation in extreme conditions. Climbing and backpacking both require specific gear, and the need to keep the load light. The inventive knife with fire starting implement is a valuable and novel way to utilize one piece of equipment for multiple purposes. A user may apply the function of lighting material, optionally cutting material, or utilizing the attached paracord as fishing line or to secure gear.

BRIEF DESCRIPTION OF THE DRAWINGS

The invention is disclosed in the following drawings which are sufficient to disclose the nature of the invention and embodiments claimed.

DETAILED DESCRIPTION, INCLUDING BEST MODES OF CARRYING OUT THE INVENTION

Figure 1:
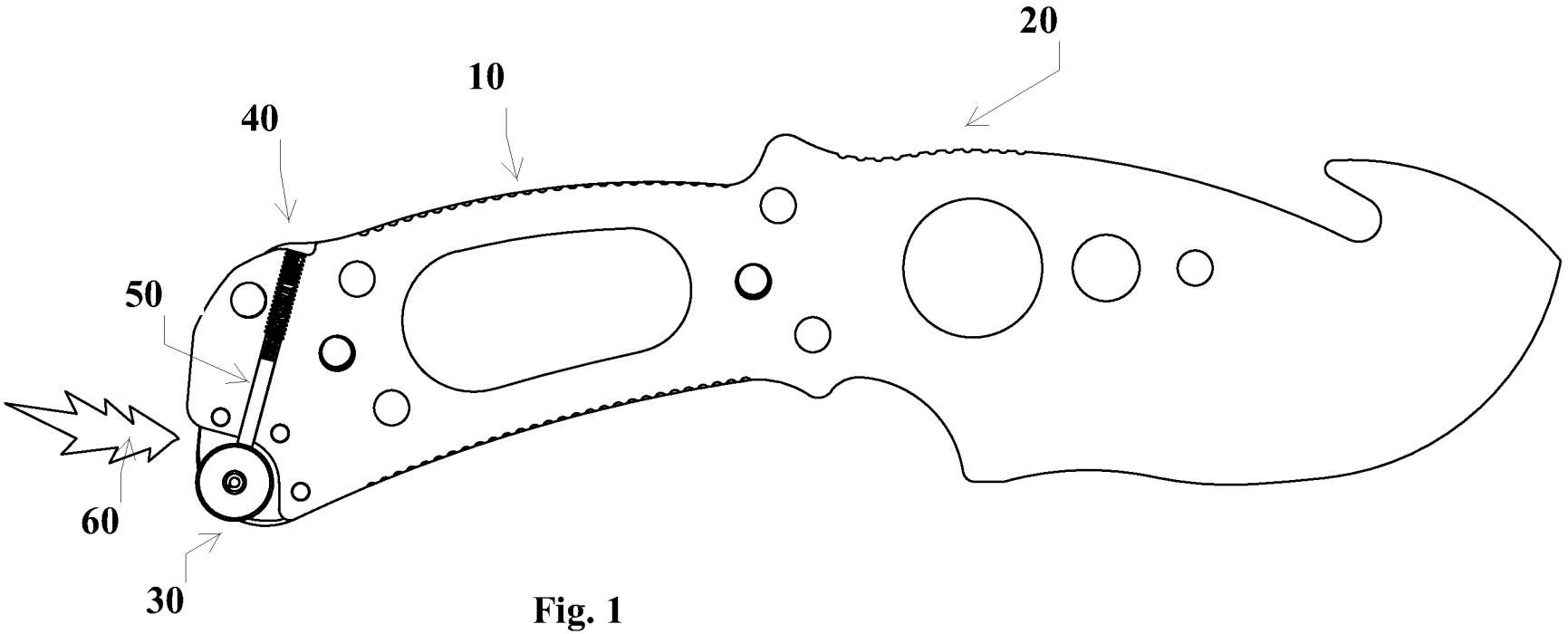
FIG. 1 is a bi-sectional view of the knife with fire starting implement.

FIG. 1 is a bisectional view of the knife. The handle 10 will house the spring and set pin 40. The spring places pressure on the ferro rod 50, and the ferro rod is forced against the spark wheel 30 when a user rotates the spark wheel. The resultant friction creates sparks 60 for igniting material. The blade 20 is shown with contouring.

Figure 2:
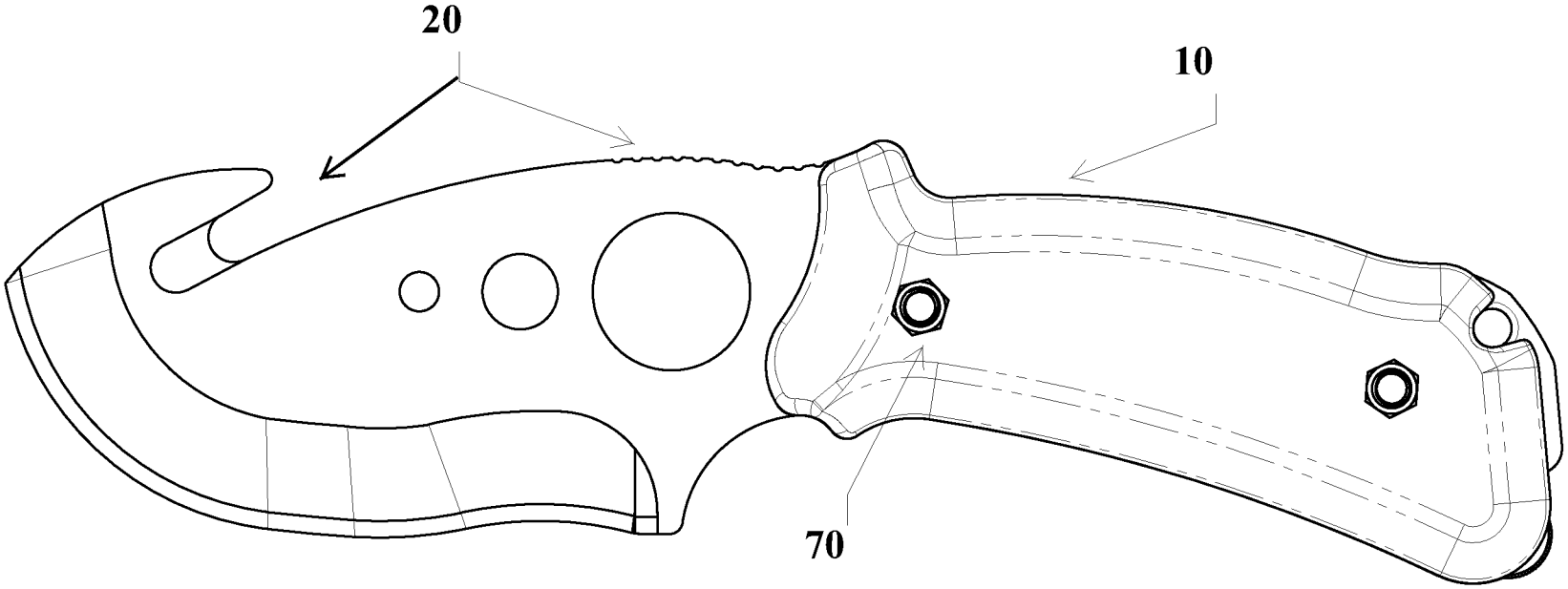
FIG. 2 is a left side perspective of the knife with fire starting implement.

FIG. 2 is another bisectional view of the knife. The blade 20 shows the contours which have utility when cutting various materials or even use for prying items one from another. The grip 100 is affixed by screws 70, and can be fabric, leather or a vinyl material.

Figure 3:
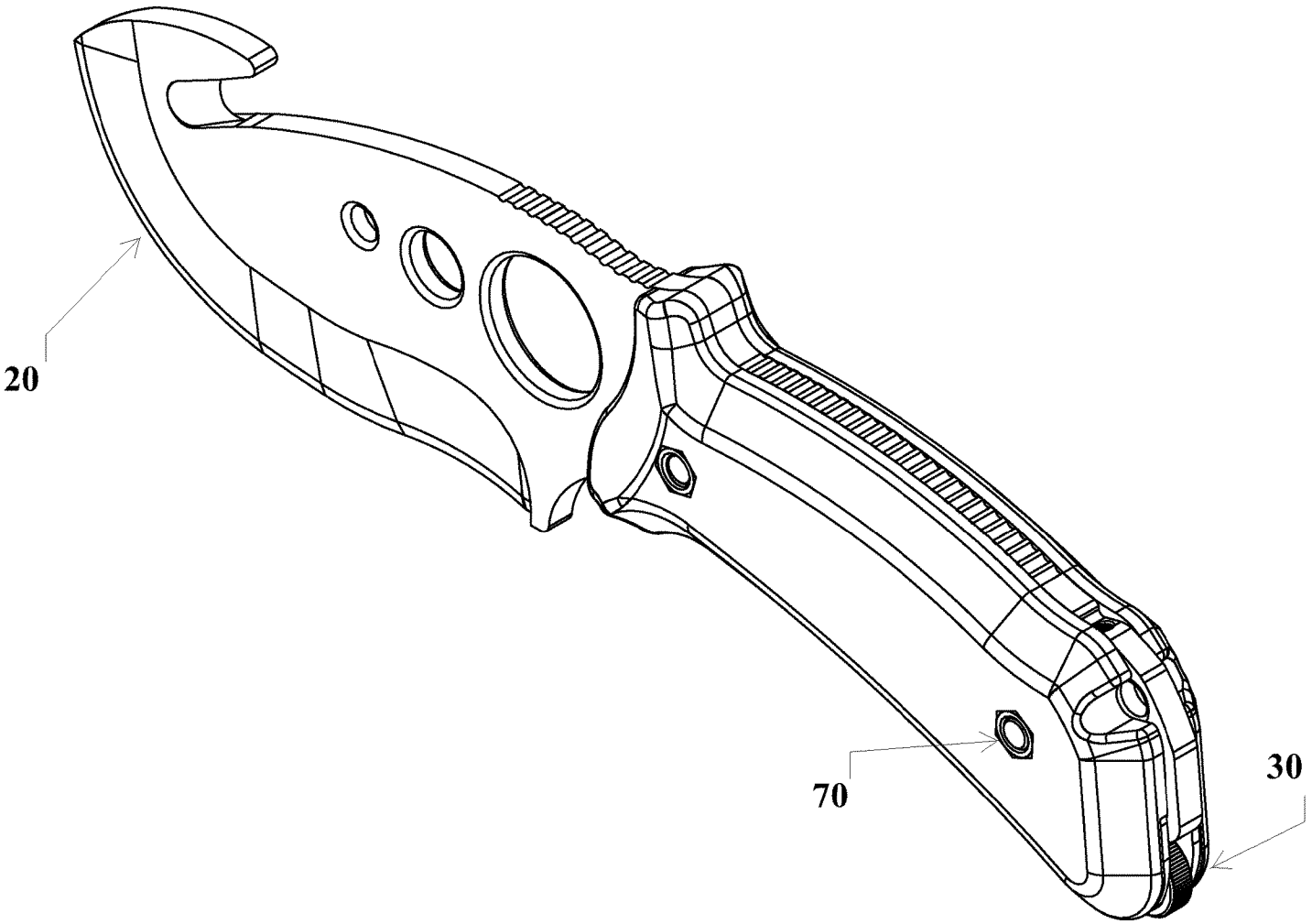
FIG. 3 is an isometric view of the knife with fire starting implement.

FIG. 3 is an isometric view of the knife, again showing the blade 20 with contouring. The handle 10 is shown with both sides attached by the screws 70. The spark wheel 30 can be seen extruding from the knife handle wherein the ferro rod and spring are not shown in this Figure.

Figure 4:
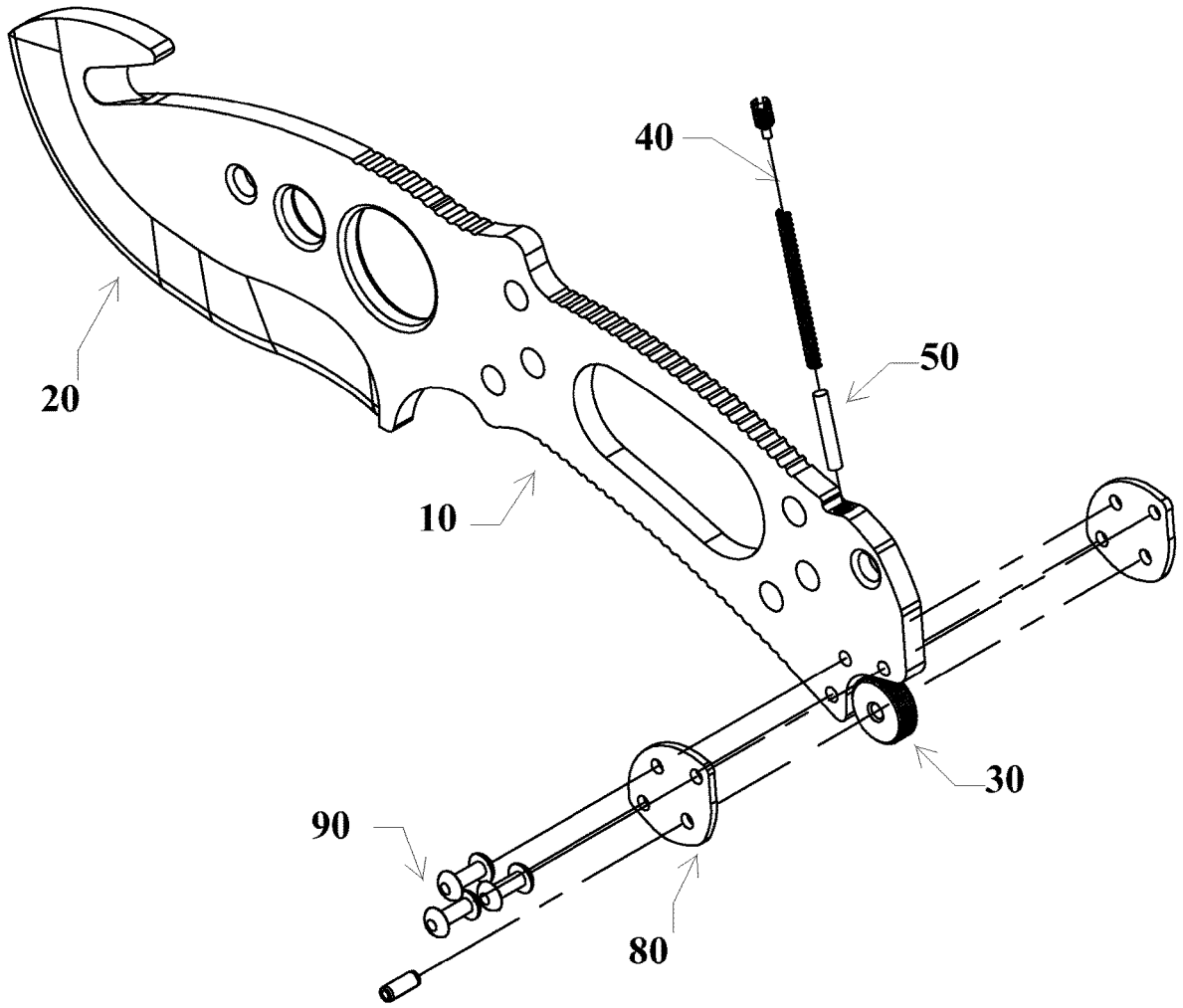
FIG. 4 is an exploded view of the knife showing the combustion pieces.

FIG. 4 is an exploded isometric view of the knife showing the blade 20 with contouring. The grip is not shown in this Figure to allow illustration of the placement of the fire-starting implements. The set screw and spring 40 are located within the knife frame and will be obscured once a grip is affixed to the handle 10. A set of plates 80 clasp to each side of the frame with rivets 90 to hold the spark wheel in place while allowing for its rotation around one of the rivets 90.

Figure 5:
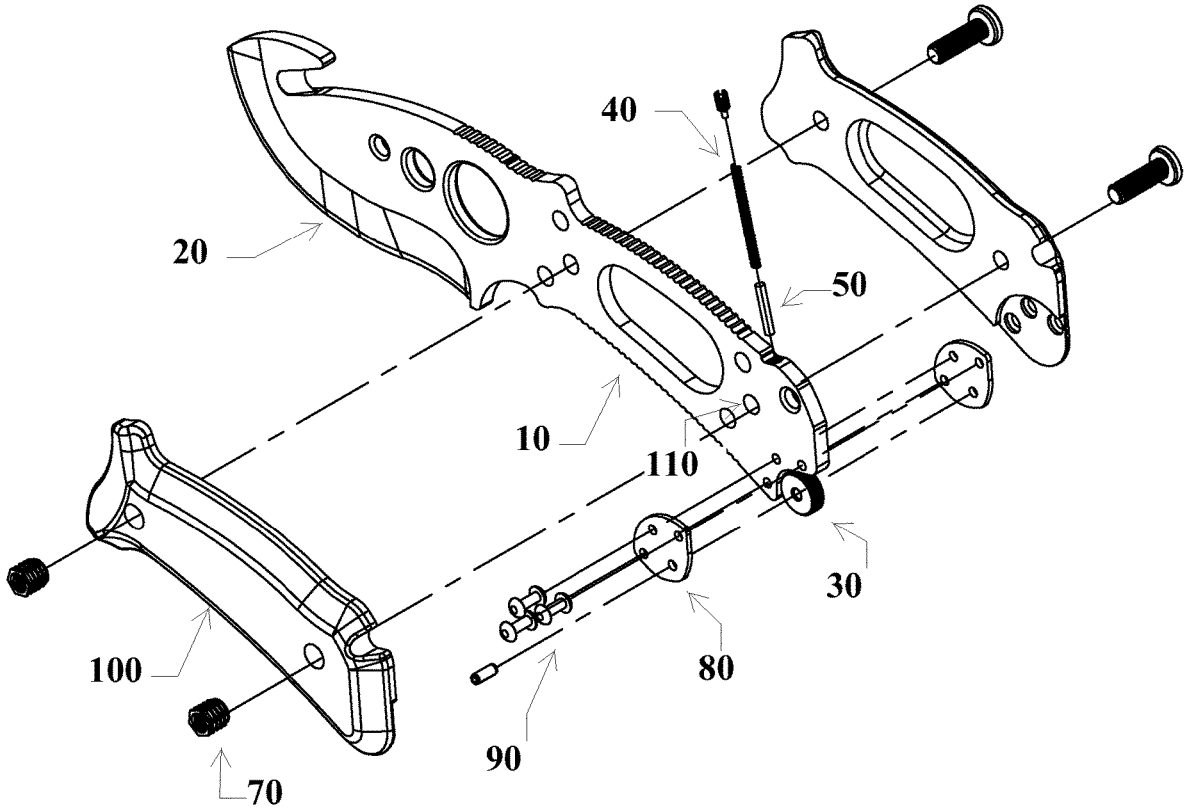
FIG. 5 is an exploded view of the view of the knife with fire-starting portions and handle.

FIG. 5 is an exploded isometric view showing the blade with contouring 20. The grip portions 100 are illustrated and are affixed to the knife handle 10 with screws 70 which go through apertures in the knife handle 110 created therefor. The rivets 90 insert through apertures 110 in the knife handle created theorfor and connect the plates 80 to the handle to hold the spark wheel 30 to the frame while allowing the wheel to be rotated. The ferro rod 50 and spring and set pin 40 are again shown.

Figure 6:
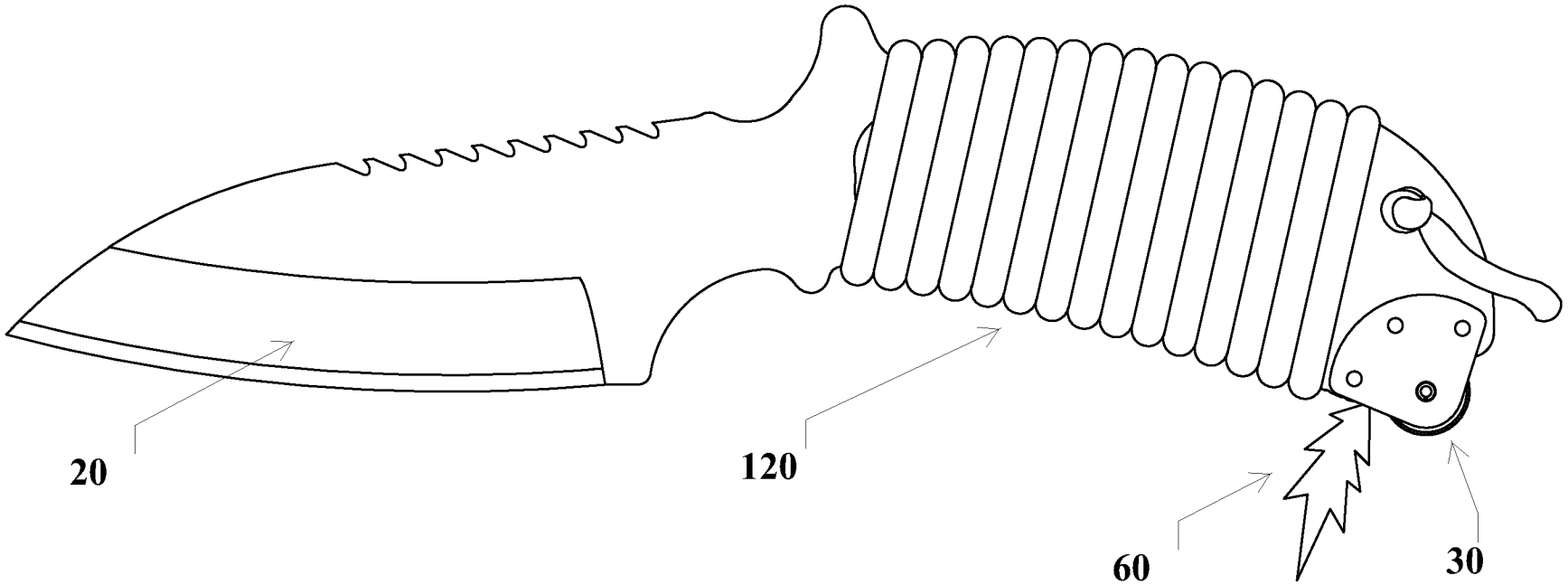
FIG. 6 is a left side perspective of the knife with contoured blade.

FIG. 6 is a left side view showing the blade with contouring 20. The grip 100 in this embodiment has nylon paracord 120 wrapped therearound which can be unwound from the knife for utility purposes commensurate with those offered by paracord. The spark wheel 30 is against shown at the base of the handle where it creates sparks 60 for igniting material.

The invention claimed is:

1. A knife comprising:

a spark wheel;

a handle portion having a first end and a second end, wherein the second end of the handle portion comprises a receiving portion adapted to receive the spark wheel therein;

a blade portion extending from the first end of the handle portion;

wherein the handle portion comprises a pair of plates removably attached to the second end of the handle portion, wherein the pair of plates covers the receiving portion, wherein the spark wheel is rotatably attached to the pair of plates.

2. The knife of claim 1, wherein the pair of plates are attached together through the spark wheel.

3. The knife of claim 2, further comprising at least one grip portion attached to the handle portion.

4. The knife of claim 3, wherein the at least one grip portion comprises two grip portions attached to opposite sides of the handle portion, wherein the spark wheel extends outwardly from the two grip portions.

5. The knife of claim 4, wherein the second opening is between the two grip portions.

6. The knife of claim 1, wherein the handle portion further comprises a hole extending through the handle portion with a first opening and a second opening and a rod disposed in the hole, wherein the first opening is next to the spark wheel, wherein the rod is biased outwardly from the first opening and against the spark wheel, wherein the rod and the spark wheel are adapted to produce a spark when a user rotates the spark wheel.

7. The knife of claim 6, wherein the rod and the spark wheel are adapted to produce the spark away from the handle portion.

8. The knife of claim 1, wherein the spark wheel extends outwardly from the receiving portion and the pair of plates.

9. The knife of claim 1, wherein the spark wheel is configured to project sparks away from the handle portion.

10. The knife of claim 1, wherein the receiving portion is shaped along a contour of the spark wheel.

11. The knife of claim 1, wherein the blade portion is fixed to the handle portion.

12. The knife of claim 1, wherein the blade portion extends continuously from the first end of the handle portion.

13. The knife of claim 1, wherein the pair of plates are removably attached to the second end of the handle portion with rivets.

14. A knife comprising:

a spark wheel;

a knife frame having a first end and a second end;

a blade extending from the first end of the knife frame; and a handle portion extending from the second end of the knife frame, wherein the handle portion comprises a receiving portion adapted to receive the spark wheel therein, wherein the handle portion comprises a pair of plates removably attached to the second end of the knife frame, and wherein the spark wheel is rotatably attached to the pair of plates.

* * * * *